US008398824B2

(12) United States Patent
Bohnert et al.

(10) Patent No.: US 8,398,824 B2
(45) Date of Patent: Mar. 19, 2013

(54) APPARATUS FOR HYDROCARBON EXTRACTION

(75) Inventors: George W. Bohnert, Harrisonville, MO (US); Galen G. Verhulst, Kansas City, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 253 days.

(21) Appl. No.: 12/777,428

(22) Filed: May 11, 2010

(65) Prior Publication Data

US 2010/0288677 A1 Nov. 18, 2010

Related U.S. Application Data

(60) Provisional application No. 61/177,505, filed on May 12, 2009.

(51) Int. Cl.
*B01D 11/00* (2006.01)

(52) U.S. Cl. ..... 196/14.52; 196/46.1; 196/139

(58) Field of Classification Search ..... 196/14.52, 196/46.1, 139; 208/390, 45
See application file for complete search history.

(56) References Cited

U.S. PATENT DOCUMENTS

| | | | | |
|---|---|---|---|---|
| 3,437,146 | A * | 4/1969 | Everhart et al. | 166/303 |
| 4,401,551 | A * | 8/1983 | Mitchell | 208/390 |
| 5,998,640 | A * | 12/1999 | Haefele et al. | 554/12 |
| 8,101,812 | B2 * | 1/2012 | Fan et al. | 585/867 |
| 2008/0047876 | A1 * | 2/2008 | Keller | 208/390 |
| 2009/0078612 | A1 * | 3/2009 | Fan et al. | 208/337 |
| 2009/0250381 | A1 * | 10/2009 | Fan et al. | 208/390 |

* cited by examiner

*Primary Examiner* — Nina Bhat
(74) *Attorney, Agent, or Firm* — Hovey Williams LLP

(57) ABSTRACT

Systems and methods for hydrocarbon extraction from hydrocarbon-containing material. Such systems and methods relate to extracting hydrocarbon from hydrocarbon-containing material employing a non-aqueous extractant. Additionally, such systems and methods relate to recovering and reusing non-aqueous extractant employed for extracting hydrocarbon from hydrocarbon-containing material.

14 Claims, 3 Drawing Sheets

APPARATUS FOR HYDROCARBON EXTRACTION

CROSS-REFERENCE TO RELATED APPLICATIONS

This application claims the priority benefit of U.S. Provisional Patent Application Ser. No. 61/177,505 entitled "APPARATUS AND METHOD FOR OIL EXTRACTION FROM TAR SANDS," filed May 12, 2009, the entire disclosure of which is incorporated herein by reference.

GOVERNMENT INTERESTS

The present invention was developed with support from the U.S. government under a contract with the United States Department of Energy, Contract No. DE-ACO4-01AL66850. Accordingly, the U.S. government has certain rights in the present invention.

BACKGROUND

1. Technical Field

One or more embodiments of the invention relate to apparatus and methods for hydrocarbon extraction from a hydrocarbon-containing material. More particularly, various embodiments of the invention relate to extracting hydrocarbon from a hydrocarbon-containing material with an extractant.

2. Description of Related Art

Oil sands (a.k.a., tar sands) are a type of hydrocarbon deposit that typically contain bitumen, which is an extra heavy type of oil or petroleum. Generally, oil sands are naturally occurring mixtures of sand, clay, water, and bitumen. Given the dense and viscous nature of bitumen, it cannot be pumped from an oil sands deposit using conventional petroleum extraction methods. Thus, various techniques have been developed to recover bitumen from oil sands deposits, such as strip mining, open pit mining, or extraction methods involving lowering the viscosity of the bitumen, such as by heating or addition of solvents.

Much of the world's petroleum reserves are in the form of oil sands. In fact, it is estimated that as much as two-thirds of the world's petroleum reserves are located in oil sands deposits, which have the combined potential to produce more than three trillion barrels of petroleum. Oil sands deposits are found throughout the world, with the largest deposits found in Canada, Venezuela, and the Middle East. In the Unites States, oil sands are generally found in the western states, primarily in Colorado, Wyoming, and Utah. Estimated U.S. bitumen reserves total near 100 billion barrels.

Historically, the relatively low cost of petroleum has made bitumen extraction unattractive for economic reasons, given the much higher cost of obtaining and upgrading bitumen compared to conventional petroleum. In recent years, however, the increased cost per barrel of oil has made bitumen extraction a profitable venture. Typically, oil sands deposits near the surface are recovered by open pit mining techniques. Large powered shovels load oil sands ore into trucks for transport to an extraction plant, where hot water separates the bitumen from the oil sands ore in large agitated separation vessels. Here, the bitumen floats to the surface and is skimmed off for further processing and refinement. These systems require large quantities of water and have an increased potential for water pollution. In arid regions, bitumen recovery by these methods places additional strain on scarce water resources. Accordingly, improved bitumen recovery methods are desired that reduce or eliminate water usage and/or pollution.

SUMMARY

One embodiment of the invention concerns a system for separating hydrocarbon from hydrocarbon-containing material using a non-aqueous extractant. The system of this embodiment comprises a dryer operable to at least partially dry the hydrocarbon-containing material; an extraction chamber in downstream communication with the dryer and operable to facilitate contact between the hydrocarbon-containing material and the non-aqueous extractant and thereby produce an extract stream comprising extracted hydrocarbon and at least a portion of the extractant and a residual stream comprising residual hydrocarbon-containing material and at least a portion of the extractant; and an extractant recovery chamber in downstream communication with the extraction chamber and operable to facilitate contact between at least a portion of the residual stream and an extractant recovery fluid to thereby recover at least a portion of the non-aqueous extractant from the residual stream.

Another embodiment of the invention concerns a method for separating hydrocarbon from hydrocarbon-containing material. The method of this embodiment comprises (a) drying the hydrocarbon-containing material in a drying zone thereby producing dried hydrocarbon-containing material; (b) contacting the dried hydrocarbon-containing material with a non-aqueous extractant thereby separating at least a portion of the hydrocarbon from the dried hydrocarbon-containing material and producing an extract stream and a residual stream, where the extract stream comprises at least a portion of the hydrocarbon and at least a portion of the non-aqueous extractant, and where the residual stream comprises at least a portion of the dried hydrocarbon-containing material and at least a portion of the non-aqueous extractant; and (c) contacting at least a portion of the residual stream with an extractant recovery fluid thereby producing a recovered extractant stream and a cleaned hydrocarbon-containing material.

Yet another embodiment of the invention concerns a method for recovering heavy oil from tar sands. The method of this embodiment comprises (a) contacting the tar sands comprising heavy oil with heated air to thereby produce dried tar sands; (b) contacting at least a portion of the dried tar sands with limonene in an extraction vessel to thereby remove at least a portion of the heavy oil from the dried tar sands and produce a first stream comprising heavy oil and limonene and a second stream comprising residual tar sands and limonene; and (c) separating at least a portion of the limonene from the residual tar sands in the second stream.

BRIEF DESCRIPTION OF THE DRAWING FIGURES

Embodiments of the present invention are described herein with reference to the attached drawing figures, wherein.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 1:
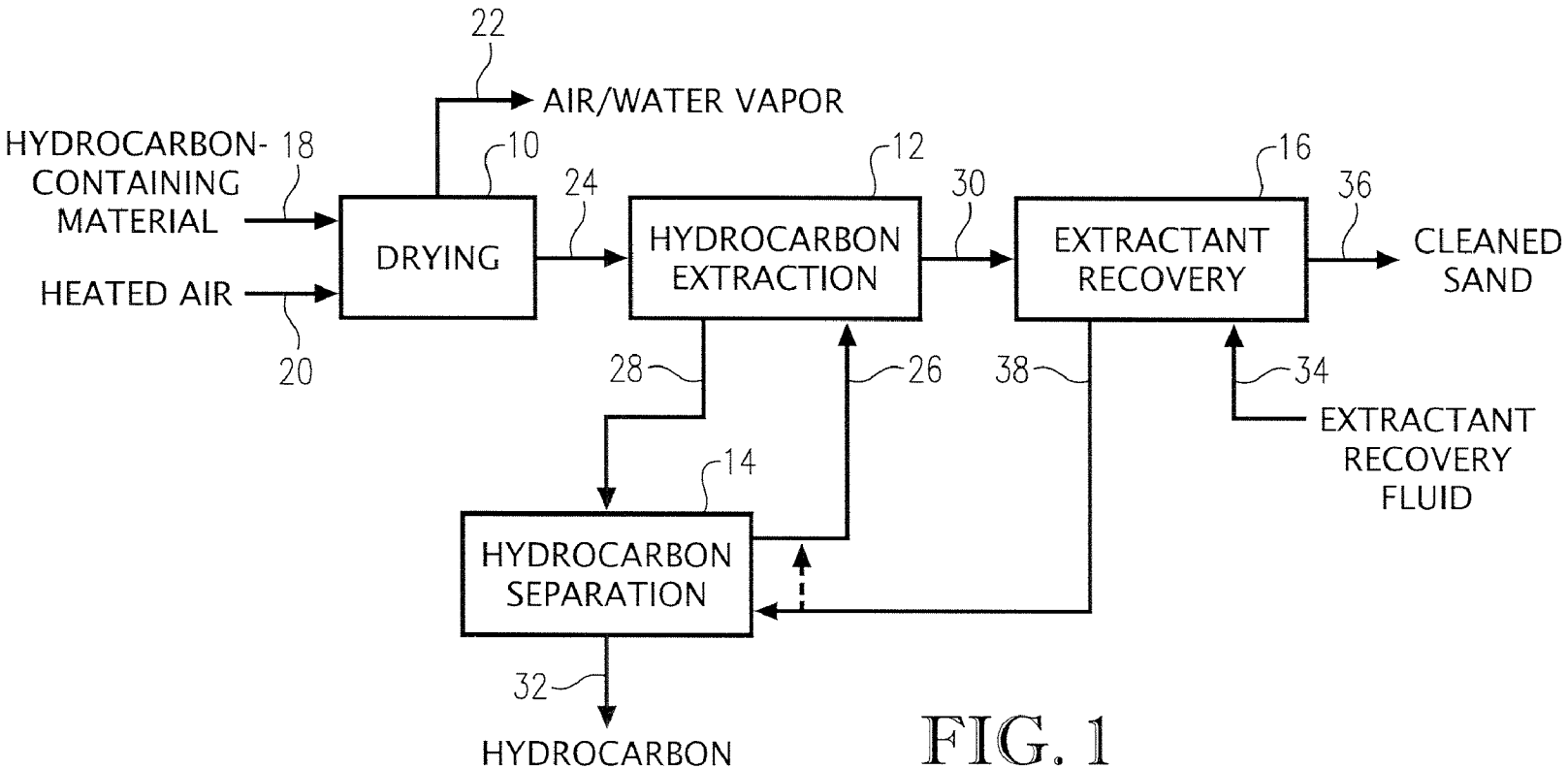
FIG. 1 is a process flow diagram illustrating a system for hydrocarbon extraction from a hydrocarbon-containing material constructed in accordance with certain embodiments of the present invention, particularly illustrating a configuration comprising a drying zone, a hydrocarbon extraction zone, a hydrocarbon separation zone, and an extractant recovery zone.

Referring initially to FIG. 1, a system for extracting hydrocarbon from a hydrocarbon-containing material is depicted comprising a drying zone 10, a hydrocarbon extraction zone 12, a hydrocarbon separation zone 14, and an extractant recovery zone 16. In the embodiment of FIG. 1, hydrocarbon-containing material can initially be introduced into the drying zone 10 via a line 18. The hydrocarbon-containing material in the line 18 can be any hydrocarbon-containing material known or hereafter discovered in the art, such as, for example, oil sands ore or oil shale. In one or more embodiments, the hydrocarbon-containing material in the line 18 is oil sands ore. As used herein, the term "oil sands ore" shall denote any material excavated from an oil sands deposit that comprises hydrocarbon and at least one inorganic component. As used herein, the term "hydrocarbon" shall be construed as it is generally understood in the art and is intended to denote any naturally-occurring organic compounds comprising hydrogen and carbon atoms, but may include other elements and compounds, such as, for example, nitrogen, oxygen, sulfur, various metals, and/or asphaltenes. Examples of such hydrocarbons include, but are not limited to, bitumen, petroleum, and kerogen. In various embodiments, the hydrocarbon-containing material in the line 18 can be in the form of a particulate solid.

In various embodiments, when the hydrocarbon-containing material in the line 18 is oil sands ore, the oil sands ore can comprise hydrocarbon in an amount of at least 1 weight percent, at least 3 weight percent, or at least 5 weight percent based on the entire weight of the oil sands ore. Additionally, the oil sands ore in the line 18 can have a hydrocarbon content of less than 40 weight percent, less than 20 weight percent, less than 15 weight percent, or less than 10 weight percent. Furthermore, the oil sands ore in the line 18 can have a hydrocarbon content in the range of from about 1 to about 40 weight percent, in the range of from about 2 to about 20 weight percent, in the range of from about 3 to about 15 weight percent, or in the range of from 5 to 10 weight percent. In various embodiments, the oil sands ore in the line 18 can have a hydrocarbon content of about 8 weight percent. In various embodiments, the hydrocarbon in the oil sands ore in the line 18 can be bitumen. Also, the oil sands ore in the line 18 can further comprise components typically found in oil sands ore, such as, for example, water, clay, and sand. In various embodiments, the hydrocarbon-containing material in the line 18 can be at ambient temperature and pressure.

When oil sands ore is employed as the hydrocarbon-containing material in the line 18, the oil sands ore can be procured employing any now known or hereafter discovered methods in the art. For example, the oil sands ore procurement process can comprise surface mining techniques, which typically involve removing the overburden on top of the oil sand deposit and thereafter excavating oil sands ore. Examples of surface mining techniques include, but are not limited to, strip mining and open pit mining. In addition to these methods, the mining process of the present invention can also employ any underground mining techniques or in situ methods known in the art.

Prior to introduction into drying zone 10, the hydrocarbon-containing material in the line 18 can undergo various pretreatment options known to those skilled in the art. For example, the hydrocarbon-containing material in the line 18 can be delumped and/or pulverized, if desired. Additionally, the line 18 can comprise any conventional or hereafter discovered methods for transporting particulate solids, such as, for example, an auger, a conveyor, or a gravity-assisted chute.

As noted above, the hydrocarbon-containing material (e.g., oil sands ore) in the line 18 can be introduced into the drying zone 10. In the drying zone 10, the hydrocarbon-containing material can be heated to remove at least a portion of water from the hydrocarbon-containing material. Such heating in the drying zone 10 can be accomplished by introducing a heated gas (e.g., air) into the drying zone 10 via the line 20. The heated gas introduced into the drying zone 10 can have a temperature in the range of from about 120 to about 220° F. The temperature in the drying zone 10 can be any temperature suitable for removing water from hydrocarbon-containing material (e.g., oil sands ore). Additionally, the temperature in the drying zone 10 can be maintained so as to effect water removal from the hydrocarbon-containing material while minimizing hydrocarbon vaporization. In various embodiments, the drying zone 10 can be maintained at an average temperature of at least 80° F., at least 100° F., or at least 120° F. Additionally, the drying zone 10 can be maintained at an average temperature in the range of from about 80 to about 190° F., in the range of from about 100 to about 170° F., or in the range of from 120 to 150° F. Drying of the hydrocarbon-containing material in the drying zone 10 can be performed at atmospheric or substantially atmospheric pressure. In alternate embodiments, drying of the hydrocarbon-containing material in the drying zone 10 can be performed under vacuum.

In one or more embodiments, the drying zone 10 can be defined within one or more dryers. Any dryers known or hereafter discovered in the art can be employed to define the drying zone 10. Examples of dryers suitable for use in defining the drying zone 10 include, but are not limited to, drum dryers, disc dryers, belt dryers, paddle dryers, fluidized beds, venturi dryers, and rotary dryers. In various embodiments, the drying zone 10 is defined within a rotary dryer.

Following drying in the drying zone 10, a vapor phase can be withdrawn via a vapor phase outlet (not depicted) in fluid-flow communication with the line 22. Additionally, after drying, a dried hydrocarbon-containing material can be withdrawn via a hydrocarbon-containing material outlet (not depicted) coupled to the line 24. As used herein, the term "dried" when referring to hydrocarbon-containing material shall mean that at least a portion of water has been removed therefrom; the term is not intended to require a complete or even substantially complete absence of water (although such a condition is not excluded). In various embodiments, the dried hydrocarbon-containing material in the line 24 can have a water content that is at least 10 weight percent, at least 20 weight percent, at least 30 weight percent, at least 40 weight percent, at least 50 weight percent, at least 60 weight percent, at least 70 weight percent, at least 80 weight percent, at least 90 weight percent, or at least 99 weight percent less than the water content of the hydrocarbon-containing material in the line 18. Additionally, the dried hydrocarbon-containing material in the line 24 can have an average temperature of less than 130° F., less than 110° F., or less than 90° F.

Following drying in the drying zone 10, the dried hydrocarbon-containing material in the line 24 can be introduced into the hydrocarbon extraction zone 12. The dried hydrocarbon-containing material in the hydrocarbon extraction zone 12 can be contacted with a non-aqueous extractant, which can be introduced into the hydrocarbon extraction zone 12 via the line 26. As used herein, the term "non-aqueous" when modifying the term extractant shall mean that the extractant comprises less than 50 weight percent water. In various embodiments, the non-aqueous extractant can have a water content of less than 40 weight percent, less than 30 weight percent, less than 20 weight percent, less than 10 weight percent, or less than 1 weight percent. Furthermore, in one or more embodiments, the non-aqueous extractant can comprise no or substantially no water.

The non-aqueous extractant employed in the hydrocarbon extraction zone 12 can comprise any substance that can at least partially dissolve a hydrocarbon. In various embodiments, the extractant can be a liquid at standard temperature and pressure ("STP"). Additionally, the extractant can have a boiling point of at least 100° F., at least 150° F., at least 175° F., at least 200° F., at least 250° F., or at least 300° F. In one or more embodiments, the extractant can have a boiling point in the range of from about 100 to about 570° F., in the range of from about 200 to about 500° F., or in the range of from 300 to 400° F. Furthermore, in one or more embodiments, the extractant can be Generally Recognized as Safe ("GRAS") according to the U.S. Food and Drug Administration. In various embodiments, the non-aqueous extractant can comprise one or more terpenes or terpene alcohols. Examples of suitable terpenes include, but are not limited to, limonene, α-pinene, β-pinene, and mixtures of two or more thereof. In one or more embodiments, the non-aqueous extractant comprises limonene. As used herein, the term "limonene" is intended to encompass all stereoisomers of limonene, as well as any racemic mixture thereof. Additionally, the non-aqueous extractant introduced into hydrocarbon extraction zone 12 via the line 26 can comprise limonene in an amount of at least 50 weight percent, at least 75 weight percent, or at least 99 weight percent. In various embodiments, limonene can constitute all or substantially all of the non-aqueous extractant employed in hydrocarbon extraction zone 12. The non-aqueous extractant in the line 26 can have a temperature in the range of from about 30 to about 90° F.

In one or more embodiments, the hydrocarbon extraction zone 12 can be operated so as to achieve countercurrent or substantial countercurrent flow of the dried hydrocarbon-containing material from the line 24 and the non-aqueous extractant from the line 26. Additionally, the hydrocarbon extraction zone 12 can be operated employing a weight ratio of hydrocarbon-containing material-to-non-aqueous extractant in the range of from about 1:10 to about 10:1, in the range of from about 1:5 to about 5:1, or in the range of from about 1:3 to about 3:1. In various embodiments, the dried hydrocarbon-containing material can be present in the hydrocarbon extraction zone 12 in an amount in the range of from about 10 to about 60 weight percent, in the range of from about 20 to about 50 weight percent or in the range of from about 30 to about 40 weight percent based on the combined weight of the dried hydrocarbon-containing material and the non-aqueous extractant. Additionally, the non-aqueous extractant can be present in the hydrocarbon extraction zone 12 in an amount in the range of from about 40 to about 90 weight percent, in the range of from about 50 to about 80 weight percent, or in the range of from 60 to 70 weight percent based on the combined weight of the dried hydrocarbon-containing material and the non-aqueous extractant.

In one or more embodiments, the non-aqueous extractant can remove at least a portion of the hydrocarbon from the dried hydrocarbon-containing material in the extraction zone 12. In various embodiments, the extractant can remove at least 50 weight percent, at least 60 weight percent, at least 70 weight percent, at least 80 weight percent, at least 90 weight percent, at least 95 weight percent, or at least 99 weight percent of the hydrocarbon from the dried hydrocarbon-containing material. Such removal can be accomplished, for example, by dissolving or substantially dissolving the hydrocarbon from the dried hydrocarbon-containing material in the non-aqueous extractant.

Contact between the dried hydrocarbon-containing material and the non-aqueous extractant can result in the formation of an extract stream and a residual stream. The extract stream can comprise extracted hydrocarbon removed from the dried hydrocarbon-containing material along with at least a portion of the non-aqueous extractant. The extract stream can be withdrawn from an extract stream outlet (not shown) in the hydrocarbon extraction zone 12 and in fluid-flow communication with a line 28. The residual stream can comprise residual hydrocarbon-containing material and at least a portion of the non-aqueous extractant. The residual stream can be withdrawn from the hydrocarbon extraction zone 12 via a residual stream outlet (not shown) in fluid-flow communication with a line 30.

The hydrocarbon extraction zone 12 can be operated at a temperature in the range of from about 20 to about 80° F. Additionally, the hydrocarbon extraction zone 12 can be operated at atmospheric pressure. Furthermore, an inert gas blanket may be employed in the head space above the non-aqueous extractant and dried hydrocarbon-containing material. Such inert gas blanket can comprise carbon dioxide or nitrogen, for example.

Apparatus suitable for use in defining hydrocarbon extraction zone 12 can be any apparatus operable to facilitate contact between a liquid and a particulate solid and thereafter separate the resulting slurry into a primarily liquid stream and a primarily solids stream. As used herein, the terms "primarily," "predominantly," and "majority" shall mean greater than 50 percent. Examples of such apparatus include, but are not limited to, rotary drum vessels and centrifuges.

Figure 2:
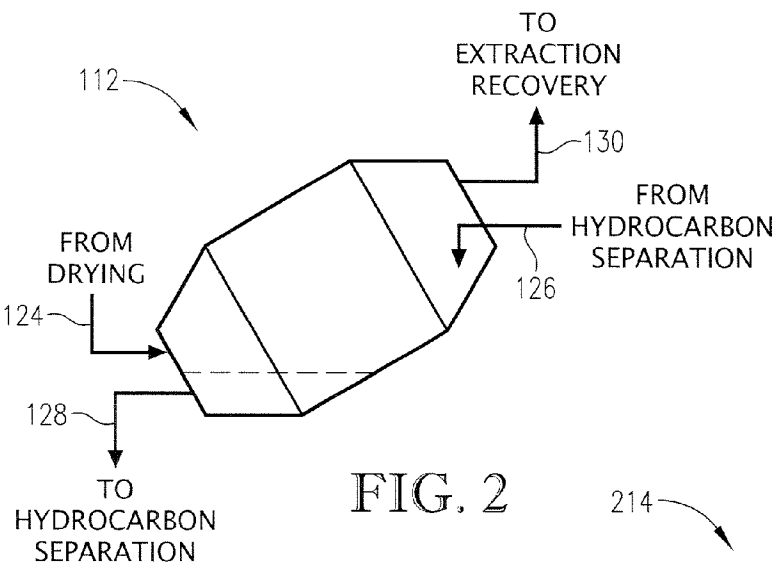
FIG. 2 is a process flow diagram particularly illustrating a rotary drum vessel suitable for use in defining a hydrocarbon extraction zone.

In various embodiments, the hydrocarbon extraction zone 12 can be defined within a rotary drum vessel. Referring now to FIG. 2, a rotary drum vessel 112 is depicted as being suitable for use in defining hydrocarbon extraction zone 12. The lines 124, 126, 128, and 130 of FIG. 2 can operate and have contents the same or substantially the same as the lines 24, 26, 28, and 30, respectively, described with reference to FIG. 1. In various embodiments, the rotary drum vessel 112 can be operated at a rotation speed in the range of from about 1 to about 10 rpm. Optionally, the rotary drum vessel 112 can be operated at increased rotation speeds for discharge of the residual stream and/or the extract stream.

In one or more embodiments, the rotary drum vessel 112 can comprise an internal spiral member (not depicted) employed for advancing the hydrocarbon-containing material from the dried hydrocarbon-containing material inlet (not depicted) to the residual hydrocarbon-containing material outlet (not depicted). Any spiral member that advances solids while permitting countercurrent flow of a liquid can be employed in the rotary drum vessel 112. Such internal spiral member can be, for example, an auger axially disposed within the rotary drum vessel 112 or spiral flights affixed along the inner surface of the rotary drum vessel 112. When an independent auger is employed, the auger can be rotated at a speed different from that of the rotary drum vessel 112 in order to advance the dried hydrocarbon-containing material. In various embodiments, the auger can have a rotational speed difference compared to the rotary drum vessel 112 in the range of about ±1 to about ±5 rpm, or in the range of from ±1 to ±3 rpm.

In one or more embodiments, the rotary drum vessel 112 can be operated at an inclined angle such that the residual hydrocarbon-containing material outlet (not depicted) is elevated above the dried hydrocarbon-containing material inlet (not depicted). In various embodiments, the rotary drum vessel 112 can be operated at an angle of at least 5°, at least 10°, or at least 15° from horizontal along its axis of rotation. Additionally, the rotary drum vessel 112 can be operated at an angle of less than 30°, less than 25°, or less than 20° from horizontal along its axis of rotation. Operating the rotary drum vessel 112 in the manner just described can create a substantially countercurrent flow of hydrocarbon-containing material and non-aqueous extractant when dried hydrocarbon-containing material is introduced into the lowered end of the rotary drum vessel 112 (e.g., via the line 124) and non-aqueous extractant is introduced into the raised end of the rotary drum vessel 112 (e.g., via the line 126). Countercurrent or substantial countercurrent flow is thus created by non-aqueous extractant flowing via gravity towards the lower end of the rotary drum vessel 112 while hydrocarbon-containing material advances to the raised end of the rotary drum vessel 112 with the aid of the above-mentioned internal spiral member (not depicted). It should be noted that the internal spiral member can extend either fully or only partially through the rotary drum vessel 112. When the internal spiral member extends only partially through the rotary drum vessel 112, the internal spiral member can extend in the range of from about 40 percent to about 70 percent of the length of the rotary drum vessel 112, and can be coterminous or substantially coterminous with the raised end of the rotary drum vessel 112. Furthermore, in various embodiments, the extractant introduced via the line 126 can be introduced in such a manner as to contact the residual hydrocarbon-containing material immediately prior to the residual hydrocarbon-containing material exiting the rotary drum vessel 112.

Referring again to FIG. 1, as mentioned above, an extract stream can be withdrawn from the hydrocarbon extraction zone 12 via the line 28. The extract stream in the line 28 can comprise extracted hydrocarbon and at least a portion of the non-aqueous extractant from the hydrocarbon extraction zone 12. In one or more embodiments, the extract stream in the line 28 can comprise hydrocarbon in an amount in the range of from about 1 to about 40 weight percent, in the range from about 5 to about 30 weight percent, or in the range of from 10 to 20 weight percent based on the entire weight of the extract stream in the line 28. Additionally, the extract stream in the line 28 can comprise non-aqueous extractant in an amount in the range of from about 60 to about 99 weight percent, in the range of from about 70 to about 95 weight percent, or in the range of from 80 to 90 weight percent.

Following withdrawal from the hydrocarbon extraction zone 12, the extract stream in the line 28 can be introduced into the hydrocarbon separation zone 14. The hydrocarbon separation zone 14 can operate to separate at least a portion of the non-aqueous extractant from the hydrocarbon in the extract stream from the line 28. Any liquid/liquid separation method known or hereafter discovered in the art can be employed in the hydrocarbon separation zone 14. In one or more embodiments, at least 50 weight percent, at least 60 weight percent, at least 70 weight percent, at least 80 weight percent, at least 90 weight percent, or at least 95 weight percent of the non-aqueous extractant in the extract stream from the line 28 can be separated in the hydrocarbon separation zone 14. In other embodiments, all or substantially all of the non-aqueous extractant in the extract stream from the line 28 can be separated in the hydrocarbon separation zone 14.

Figure 3:
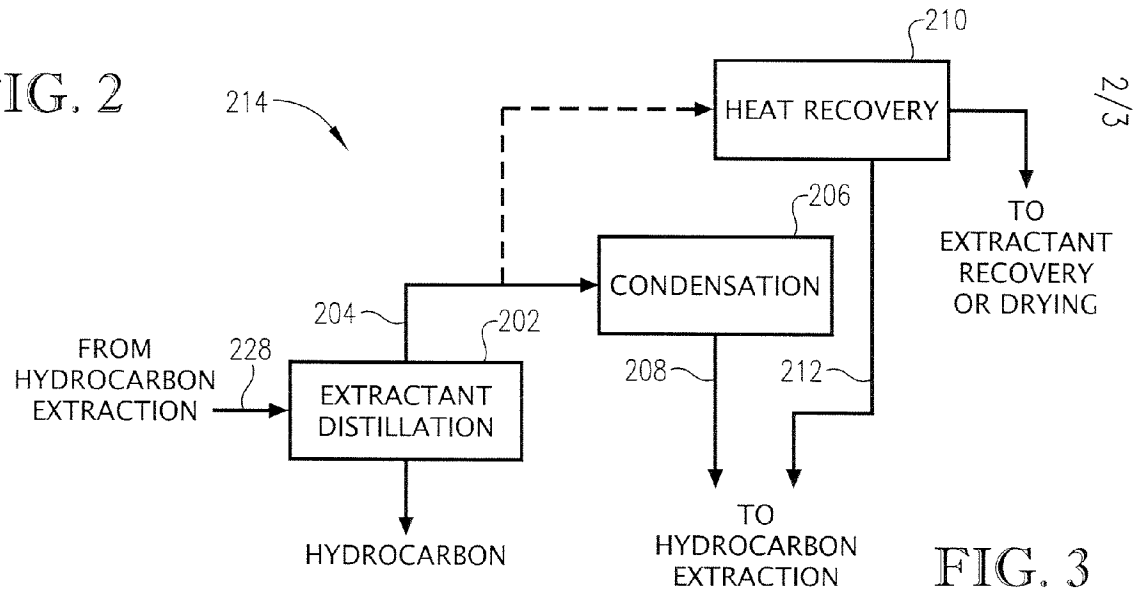
FIG. 3 is a process flow diagram illustrating in detail a hydrocarbon separation system constructed in accordance with certain embodiments of the present invention.

In various embodiments, the hydrocarbon separation zone 14 can be defined within a distillation still or distillation column. Furthermore, in one or more embodiments, a distillation system such as the one depicted in FIG. 3 can be employed for hydrocarbon separation zone 14. Referring now to FIG. 3, an extract stream can initially be introduced into the distillation unit 202 via the line 228. The extract stream in the line 228 can be the same or substantially the same as the extract stream in the line 28, described with reference to FIG. 1. Distillation unit 202 can be any conventional or hereafter discovered distillation still or distillation column. Distillation unit 202 can be operated at any temperature and pressure sufficient to separate non-aqueous extractant from the extract stream. In various embodiments, distillation in distillation unit 202 can be performed at elevated temperature and atmospheric pressure. Alternatively, distillation in distillation unit 202 can be operated under reduced pressure, thereby permitting lower temperatures to be employed.

Vapor phase non-aqueous extractant can be withdrawn from the distillation unit 202 via the line 204 and routed to a condensation unit 206. The condensation unit 206 can operate using any known or hereafter discovered methods for condensing a vapor. The resulting condensed vapor can be withdrawn from the condensation unit 206 via the line 208 and routed to a hydrocarbon extraction zone, such as the hydrocarbon extraction zone 12, described with reference to FIG. 1. In an alternative embodiment, heat can be recovered from the vapor-phase non-aqueous extractant in a heat recovery zone 210. Heat recovery zone 210 can comprise any known or hereafter discovered methods for recovering heat from a vapor. For example, the vapor phase extractant from the line 204 could optionally be employed to heat the working fluid in a Rankine cycle. Recovered energy from the heat recovery zone 210 can be employed in various other parts of the system depicted in FIG. 1, such as, for example, in the drying zone 10 (e.g., to heat the gas employed for drying) or the extractant recovery zone 16. Condensed non-aqueous extractant can be withdrawn from the heat recovery zone 210 via the line 212 and can be routed to a hydrocarbon extraction zone, such as the hydrocarbon extraction zone 12, described with reference to FIG. 1.

Referring again to FIG. 1, following separation in the hydrocarbon separation zone 14, a hydrocarbon rich stream can be withdrawn via the line 32 and a non-aqueous extractant rich stream can be withdrawn via the line 26. In various embodiments, bitumen can constitute at least 90, at least 95, or at least 99 weight percent of the hydrocarbon rich stream in the line 32. Additionally, the hydrocarbon rich stream in the line 32 can comprise residual amounts of non-aqueous extractant (e.g., limonene). In various embodiments, the hydrocarbon rich stream in the line 32 can comprise non-aqueous extractant in an amount of less than 10, less than 5, or less than 1 weight percent. The non-aqueous extractant rich stream in the line 26 can comprise non-aqueous extractant in an amount of at least 90, at least 95, or at least 99 weight percent. As noted above, at least a portion of the non-aqueous extractant rich stream in the line 26 can be routed back to the hydrocarbon extraction zone 12 to be employed for further hydrocarbon extraction. It should be noted that, although a closed-loop system is employed, make up non-aqueous extractant can be introduced into the hydrocarbon extraction zone 12 to account for losses of non-aqueous extractant, such as by incomplete separation in the hydrocarbon separation zone 14.

Referring still to FIG. 1, as noted above, a residual stream can be withdrawn from the hydrocarbon extraction zone 12 via the line 30. The residual stream in the line 30 can comprise residual hydrocarbon-containing material, non-aqueous extractant, and/or minor amounts of hydrocarbon. The residual hydrocarbon-containing material can comprise all or substantially all of the components of the dried hydrocarbon-containing material introduced into the hydrocarbon extraction zone 12 with the exception of the hydrocarbon removed during hydrocarbon extraction. For example, when the hydrocarbon-containing material is oil sands ore, the residual hydrocarbon-containing material can typically comprise clay, sand, and/or other typically inorganic components. The residual stream in the line 30 can comprise residual hydrocarbon-containing material in an amount of at least 80 weight percent, at least 90 weight percent, at least 95 weight percent, or at least 99 weight percent based on the entire weight of the residual stream in the line 30. Additionally, the residual stream in the line 30 can comprise a combined amount of hydrocarbon and non-aqueous extractant in the range of from about 0.1 to about 10 weight percent, in the range of from about 0.5 to about 5 weight percent, or in the range of from 1 to 3 weight percent based on the entire weight of the residual stream in the line 30. Furthermore, the hydrocarbon can constitute in the range of from about 1 to about 30 weight percent, in the range of from about 3 to about 20 weight percent, or in the range of from 5 to 15 weight percent of the combined hydrocarbon and non-aqueous extractant in the residual stream in the line 30.

In various embodiments, the residual hydrocarbon-containing material stream in the line 30 can be introduced into the extractant recovery zone 16. The extractant recovery zone 16 can operate to remove at least a portion of hydrocarbon and/or non-aqueous extractant from the residual stream. Any methods known or hereafter discovered in the art for separating hydrocarbon and/or non-aqueous extractant from a solid particulate material can be employed in the extractant recovery zone 16.

In one or more embodiments, the residual stream can be contacted with an extractant recovery fluid, which can be introduced into extractant recovery zone 16 via a line 34. Any fluid capable of removing at least a portion of hydrocarbon and/or non-aqueous extractant from the residual hydrocarbon-containing material can be employed in extractant recovery zone 16. In various embodiments, the extractant recovery fluid can comprise carbon dioxide. Furthermore, the carbon dioxide can be at least partially in a liquid or supercritical state. In one or more embodiments, at least 50 weight percent, at least 60 weight percent, at least 70 weight percent, at least 80 weight percent, at least 90 weight percent, or at least 95 weight percent of the carbon dioxide can be in a liquid state upon initial contact with the residual hydrocarbon-containing material in extractant recovery zone 16. In further embodiments, the carbon dioxide can be completely or substantially completely in the liquid phase upon initial contact with the residual hydrocarbon-containing material in the extractant recovery zone 16. In various embodiments, the extractant recovery fluid can be under pressure upon introduction into the extractant recovery zone 16. For example, the extractant recovery fluid in the line 34 can be under a pressure of at least 500 pounds per square inch gauge ("psig"), at least 650 psig, or at least 800 psig. In other embodiments, the extractant recovery fluid in the line 34 can be under a pressure in the range of from about 500 to about 1,200 psig, in the range of from about 650 to about 1,050 psig, or in the range of from 800 to 900 psig. Additionally, the extractant recovery fluid in the line 34 can be at a temperature in the range of from about 50 to about 100° F. or in the range of from 60 to 80° F.

Following treatment in extractant recovery zone 16, a cleaned residual hydrocarbon-containing material can be withdrawn via a line 36. When oil sands ore is employed as the hydrocarbon-containing material, the cleaned residual hydrocarbon-containing material can consist essentially of cleaned sand. In one or more embodiments, the cleaned residual hydrocarbon-containing material in the line 36 can have a hydrocarbon content of less than 1 weight percent, less than 0.5 weight percent, less than 0.1 weight percent, less than 0.05 weight percent, or less than 0.01 weight percent. Similarly, the cleaned residual hydrocarbon-containing material in the line 36 can comprise non-aqueous extractant in an amount of less than 1 weight percent, less than 0.5 weight percent, less than 0.1 weight percent, less than 0.05 weight percent, or less than 0.01 weight percent. The cleaned residual hydrocarbon-containing material in the line 36 can be disposed of according to any known or hereafter discovered methods in the art.

The recovered non-aqueous extractant and hydrocarbon can be at least partially separated from the extractant recovery fluid and withdrawn from the extractant recovery zone 16 via a line 38. Separation of the non-aqueous extractant and hydrocarbon from the extractant recovery fluid can be achieved by any liquid/liquid separation techniques known or hereafter discovered in the art. At least a portion of the separated extractant recovery fluid can be employed again for removing hydrocarbon and non-aqueous extractant from fresh residual hydrocarbon-containing material. In various embodiments, all or substantially all of the separated extractant recovery fluid can be employed again for removing hydrocarbon and non-aqueous extractant from fresh residual hydrocarbon-containing material. The separated non-aqueous extractant and hydrocarbon in the line 38 can be routed to hydrocarbon separation zone 14, where the hydrocarbon and non-aqueous extractant can be at least partially separated. Alternatively, at least a portion of the non-aqueous extractant and hydrocarbon in the line 38 can optionally be combined with the non-aqueous extractant in the line 26 and routed directly to the hydrocarbon extraction zone 12. The fluid in the line 38 can contain non-aqueous extractant in an amount in the range of from about 50 to about 99 weight percent, in the range of from about 60 to about 98 weight percent, or in the range of from 70 to 97 weight percent. Additionally, the fluid in the line 38 can contain hydrocarbon in an amount in the range of from about 1 to about 50 weight percent, in the range of from about 2 to about 40 weight percent, or in the range of from 3 to 30 weight percent.

Figure 4:
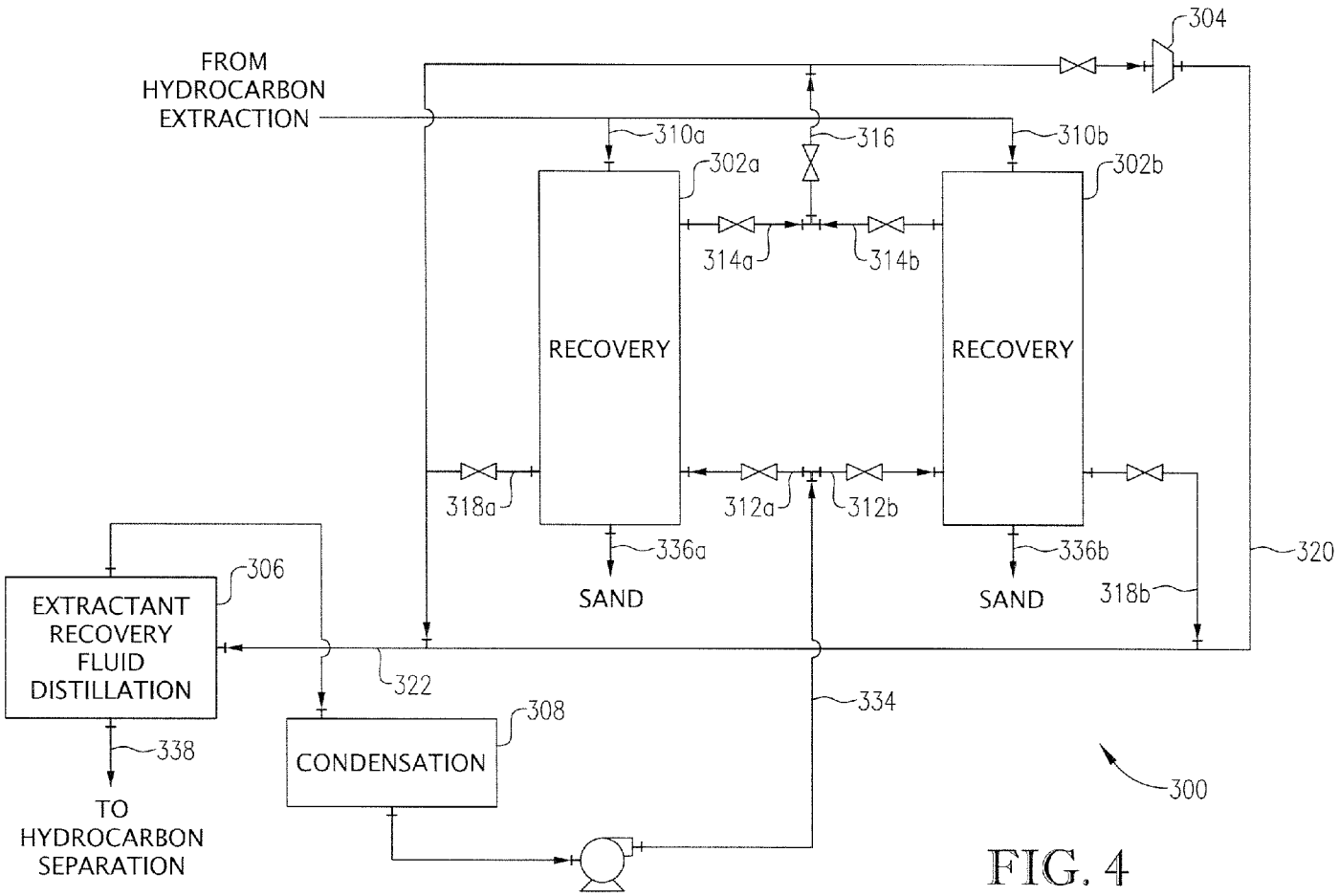
FIG. 4 is a process flow diagram illustrating in detail an extractant recovery system constructed in accordance with certain embodiments of the present invention.

Referring now to FIG. 4, an extractant recovery system 300 is depicted comprising two recovery columns 302*a,b*, a compressor 304, a distillation unit 306, and a condensation unit 308. In one or more embodiments, the extractant recovery system 300 depicted in FIG. 4 can be employed as extractant recovery zone 16, described with reference to FIG. 1.

In operation, residual hydrocarbon-containing material (e.g., residual oil sands ore) can be gravity feed via the line

310*a* into the recovery column 302*a*, which can be gas blanketed with carbon dioxide. Alternatively, though not depicted, residual hydrocarbon-containing material could be bottom-filled into the recovery column 302*a*. In various embodiments, recovery column 302*a* can be only partially filled with residual hydrocarbon-containing material. For example, recovery column 302*a* can be filled to a level of less than 100 volume percent but greater than 60, greater than 70, greater than 80, or greater than 85 volume percent. In various embodiments, recovery column 302*a* can be filled with residual hydrocarbon-containing material to about 90 volume percent. Thereafter, extractant recovery fluid (e.g., liquid carbon dioxide) can be introduced via the line 312*a* at or near the bottom of the recovery column 302*a* to completely or substantially completely fill recovery column 302*a*. Overflow extractant recovery fluid can be routed back to the distillation unit 306 via the lines 314*a* and 316. Alternatively, though not depicted, extractant recovery fluid could be introduced at or near the top of the recovery column 302*a*, such that the extractant recovery fluid would flow in a downward manner through the recovery column 302*a* and could be removed via a lower outlet, such as via the line 318*a*. In various embodiments, sufficient extractant recovery fluid can be introduced to the recovery column 302*a* to give at least 1, at least 2, or at least 3 volume exchanges within the residual hydrocarbon-containing material interfaces. In other embodiments, sufficient extractant recovery fluid can be introduced to the recovery column 302*a* to give in the range of from about 1 to about 20, in the range of from about 2 to about 10, or in the range of from 3 to 7 volume exchanges within the residual hydrocarbon-containing material interfaces.

After the desired amount of extractant recovery fluid has been introduced into the recovery column 302*a*, the flow can be stopped and at least a portion of the extractant recovery fluid can be drained from the recovery column 302*a* via the line 318*a* and routed back to the distillation unit 306. In various embodiments, after draining, gas within the recovery column 302*a* can be used to repressurize the recovery column 302*b* to an equilibrium pressure, which can be about 400 psig. Thereafter, at least a portion of the remainder of the gas in the recovery column 302*a* can be recovered with the aid of the compressor 304 and routed back to the distillation unit 306 via the line 320. In various embodiments, the compressor 304 can be filter-protected and can comprise one or more compressor units. In various embodiments, although not depicted, the compressor 304 can discharge at least a portion of the recovered gas directly to the condenser unit 308.

After removing the extractant recovery fluid, the cleaned residual hydrocarbon-containing material can be gravity flowed from the recovery column 302*a* via the line 336*a*. The cleaned residual hydrocarbon-containing material in the line 336*a* can have the same or substantially the same composition as the cleaned residual hydrocarbon-containing material in the line 36, described with reference to FIG. 1. In an alternative embodiment, emptying the recovery column 302*a* of cleaned residual hydrocarbon-containing material can be performed by stopping recovery of the extractant recovery fluid at approximately 10 psig and using the residual gas pressure to pneumatically convey the cleaned residual hydrocarbon-containing material to a desired location.

Following extractant recovery in the recovery column 302*a*, extractant recovery can be performed on residual hydrocarbon-containing material introduced via the line 310*b* in the recovery column 302*b* in the same or substantially the same manner just described with reference to the recovery column 302*a*, with the recovery column 302*b* and the lines 312*b*, 314*b*, 318*b*, and 336*b* functioning in the same or substantially the same manner described above with reference to the recovery column 302*a* and the lines 312*a*, 314*a*, 318*a*, and 336*a*, respectively. As will be recognized by those skilled in the art, the advantage of employing a dual recovery column system such as the one depicted in FIG. 4 lies in the fact that extractant recovery can be performed in one recovery column while introducing residual hydrocarbon-containing material to the other column. Thus, while extractant recovery in a single recovery column is a batch process, the use of at least two recovery columns simulates continuous or substantially continuous operation.

Following extractant recovery, the spent extractant recovery fluid from the recovery column 302*a* and/or 302*b* can be routed to distillation unit 306 via the line 322. The spent extractant recovery fluid in the line 322 can comprise extractant recovery fluid (e.g., carbon dioxide) in an amount of at least 60 weight percent, at least 70 weight percent, or at least 85 weight percent. Additionally, the spent extractant recovery fluid in the line 322 can comprise a combined amount of hydrocarbon (e.g., bitumen) and non-aqueous extractant (e.g., limonene) of at least 0.01 weight percent and up to 40 weight percent, up to 30 weight percent, up to 15 weight percent, up to 10 weight percent, or up to 5 weight percent. The distillation unit 306 can operate to separate at least a portion of the extractant recovery fluid from the non-aqueous extractant and/or hydrocarbon in the spent extractant recovery fluid from the line 322. Distillation in the distillation unit 306 can be performed at any temperature and pressure combination sufficient to remove at least a portion of the extractant recovery fluid (e.g., carbon dioxide). Separated extractant recovery fluid can be at least partially condensed in the condensation unit 308 and returned via the line 334 to either of the recovery columns 302*a,b* for further use in recovering non-aqueous extractant.

Following separation in the distillation unit 306, the bottoms containing non-aqueous extractant and hydrocarbon can be withdrawn via the line 338. The contents of the line 338 can be the same or substantially the same as the contents of the line 38, described above with reference to FIG. 1. It should be noted that, although the system depicted in FIG. 4 is a closed-loop system, additional extractant recovery fluid (e.g., carbon dioxide) can be added as needed to make up for losses, such as by impartial separation of extractant recovery fluid in the distillation unit 306.

Employing the system as described above with reference to FIGS. 1-4 can remove a significant portion of hydrocarbon contained in the initial hydrocarbon-containing material introduced into the system via the line 18. Overall, the hydrocarbon in the line 32, which includes hydrocarbon recovered both from the hydrocarbon extraction zone 12 and the extractant recovery zone 16, can constitute at least 70 weight percent, at least 80 weight percent, at least 90 weight percent, at least 99 weight percent, or at least 99.9 weight percent of the hydrocarbon initially contained in the hydrocarbon-containing material introduced from the line 18.

Although the invention has been described with reference to the embodiments illustrated in the attached drawing figures, it is noted that equivalents may be employed and substitutions made herein without departing from the scope of the invention as recited in the claims.

SELECTED DEFINITIONS

It should be understood that the following is not intended to be an exclusive list of defined terms. Other definitions may be provided in the foregoing description accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "containing," "contains," and "contain" have the same open-ended meaning as "comprising," "comprises," and "comprise" provided above.

As used herein, the terms "having," "has," and "have" have the same open-ended meaning as "comprising," "comprises," and "comprise" provided above.

As used herein, the terms "including," "includes," and "include" have the same open-ended meaning as "comprising," "comprises," and "comprise" provided above.

NUMERICAL RANGES

The present description uses numerical ranges to quantify certain parameters relating to various embodiments of the invention. It should be understood that when numerical ranges are provided, such ranges are to be construed as providing literal support for claim limitations that only recite the lower value of the range as well as claim limitations that only recite the upper value of the range. For example, a disclosed numerical range of 10 to 100 shall be construed as providing literal support for a claim limitation reciting "greater than 10" (with no upper bounds) and a claim limitation reciting "less than 100" (with no lower bounds).

What is claimed is:

1. A system for separating hydrocarbon from hydrocarbon-containing material using a non-aqueous extractant, said system comprising:

a dryer operable to at least partially dry said hydrocarbon-containing material;

an extraction chamber in downstream communication with said dryer and operable to facilitate contact via a substantially countercurrent flow between said hydrocarbon-containing material and said non-aqueous extractant and thereby produce an extract stream comprising extracted hydrocarbon and at least a portion of said non-aqueous extractant and a residual stream comprising residual hydrocarbon-containing material and at least a portion of said non-aqueous extractant; and an extractant recovery chamber in downstream communication with said extraction chamber and operable to facilitate contact between at least a portion of said residual stream and an extractant recovery fluid to thereby recover at least a portion of said non-aqueous extractant from said residual stream.

2. The system of claim 1, further comprising a hydrocarbon separation chamber in downstream communication with said extraction chamber and operable to separate at least a portion of said extracted hydrocarbon from said non-aqueous extractant in said extract stream.

3. The system of claim 2, wherein said hydrocarbon separation chamber is defined within a distillation still or distillation column.

4. The system of claim 1, wherein said extraction chamber is defined within a rotary drum vessel.

5. The system of claim 4, wherein said rotary drum vessel comprises a hydrocarbon-containing material inlet and a residual stream outlet, wherein said rotary drum vessel comprises an internal spiral member for advancing said hydrocarbon-containing material from said hydrocarbon-containing material inlet to said residual stream outlet.

6. The system of claim 5, wherein said internal spiral member is selected from the group consisting of an auger and spiral flights affixed along the inner surface of said rotary drum vessel.

7. The system of claim 5, wherein said rotary drum vessel is inclined at an angle of at least 5° from horizontal along its axis of rotation with said residual stream outlet being elevated above said hydrocarbon-containing material inlet.

8. The system of claim 4, wherein said rotary drum vessel comprises a non-aqueous extractant inlet for introducing said non-aqueous extractant into said extraction chamber.

9. The system of claim 8, wherein said non-aqueous extractant inlet is positioned to allow said substantially countercurrent flow between said non-aqueous extractant and said hydrocarbon-containing material.

10. The system of claim 1, wherein said extractant recovery chamber is defined within one or more substantially vertical column vessels.

11. The system of claim 10, wherein said vertical column vessels are operable to facilitate contact between a liquid or supercritical carbon dioxide and at least a portion of said residual stream.

12. The system of claim 11, wherein said vertical column vessels comprise one or more normally upper inlets operable to receive at least a portion of said residual stream, wherein said vertical column vessels comprise one or more normally lower inlets operable to introduce said liquid or supercritical carbon dioxide into said vertical column vessels.

13. The system of claim 11, said system further comprising a distillation unit in downstream communication with said extractant recovery chamber and operable to at least partially separate said liquid or supercritical carbon dioxide and said non-aqueous extractant.

14. The system of claim 1, wherein said dryer is a rotary dryer.

* * * * *